US008144886B2

(12) United States Patent
Ishibashi

(10) Patent No.: US 8,144,886 B2
(45) Date of Patent: Mar. 27, 2012

(54) AUDIO CONFERENCING APPARATUS

(75) Inventor: Toshiaki Ishibashi, Fukuroi (JP)

(73) Assignee: Yamaha Corporation (JP)

( * ) Notice: Subject to any disclaimer, the term of this patent is extended or adjusted under 35 U.S.C. 154(b) by 899 days.

(21) Appl. No.: 12/162,934

(22) PCT Filed: Jan. 17, 2007

(86) PCT No.: PCT/JP2007/050617

§ 371 (c)(1),
(2), (4) Date: Jul. 31, 2008

(87) PCT Pub. No.: WO2007/088730

PCT Pub. Date: Aug. 9, 2007

(65) Prior Publication Data

US 2009/0052684 A1 Feb. 26, 2009

(30) Foreign Application Priority Data

Jan. 31, 2006 (JP) ..... 2006-023422

(51) Int. Cl.
*H04R 3/00* (2006.01)

(52) U.S. Cl. ..... 381/66; 381/92; 381/87

(58) Field of Classification Search ..... 381/66, 381/92, 87

See application file for complete search history.

(56) References Cited

U.S. PATENT DOCUMENTS 4,311,874 A * 1/1982 Wallace, Jr. ..... 381/87
5,138,651 A 8/1992 Sudo
5,832,077 A 11/1998 Ciurpita
7,123,727 B2 * 10/2006 Elko et al. ..... 381/92
7,576,777 B2 * 8/2009 Kondo et al. ..... 348/208.4
2003/0016835 A1 * 1/2003 Elko et al. ..... 381/92
2003/0026437 A1 2/2003 Janse et al.
2004/0170284 A1 9/2004 Janse et al.
2004/0175006 A1 * 9/2004 Kim et al. ..... 381/92
2005/0207566 A1 * 9/2005 Ohki et al. ..... 379/406.01
2006/0153360 A1 7/2006 Kellermann et al.

(Continued)

FOREIGN PATENT DOCUMENTS

EP 1596634 A2 11/2005

(Continued)

OTHER PUBLICATIONS

Search report issued in corresponding application No. PCT/JP2007/050617, mailed May 1, 2007.

(Continued)

*Primary Examiner* — Laura Menz
(74) *Attorney, Agent, or Firm* — Rossi, Kimms & McDowell LLP

(57) ABSTRACT

Microphones arranged in an array shape along a longitudinal direction are respectively formed in both the longitudinal side surfaces of a housing 2 with substantially an elongated rectangular parallelepiped shape, and speakers arranged in an array shape along the longitudinal direction are formed in a lower surface. The speaker array forms sound emission beams based on sound emission directivity set according to a conference environment. On the other hand, when the microphone array forms sound collection beams by sound collection signals collected, a talker direction is detected from these beams and an output sound signal corresponding to this direction is formed and also is reflected on setting of the sound emission directivity. Also, when there are plural input sound signals, the sound emission directivity is set according to a use situation of the plural input sound signals.

8 Claims, 12 Drawing Sheets

U.S. PATENT DOCUMENTS

| | | | | |
|---|---|---|---|---|
| 2009/0016515 | A1* | 1/2009 | Ishibashi et al. | 379/202.01 |
| 2009/0052684 | A1* | 2/2009 | Ishibashi | 381/66 |
| 2009/0052688 | A1* | 2/2009 | Ishibashi et al. | 381/92 |
| 2009/0147967 | A1* | 6/2009 | Ishibashi et al. | 381/92 |
| 2009/0180633 | A1* | 7/2009 | Ishibashi et al. | 381/59 |
| 2009/0248408 | A1* | 10/2009 | Ishibashi et al. | 704/226 |
| 2009/0252364 | A1* | 10/2009 | Saito et al. | 381/355 |
| 2009/0274318 | A1* | 11/2009 | Ishibashi et al. | 381/92 |
| 2009/0310794 | A1* | 12/2009 | Ishibashi et al. | 381/66 |
| 2010/0165071 | A1* | 7/2010 | Ishibashi et al. | 348/14.08 |
| 2010/0166195 | A1* | 7/2010 | Ukai et al. | 381/26 |
| 2010/0166212 | A1* | 7/2010 | Ishibashi et al. | 381/92 |
| 2010/0172514 | A1* | 7/2010 | Ishibashi | 381/94.1 |
| 2011/0019836 | A1* | 1/2011 | Ishibashi et al. | 381/92 |
| 2011/0110526 | A1* | 5/2011 | Ishibashi et al. | 381/66 |

FOREIGN PATENT DOCUMENTS

| | | | | |
|---|---|---|---|---|
| JP | 58-056563 | A | | 4/1983 |
| JP | 03-136557 | A | | 11/1991 |
| JP | 5-158492 | A | | 6/1993 |
| JP | 8-298696 | A | | 11/1996 |
| JP | 10-285083 | A | | 10/1998 |
| JP | 11-055784 | A | | 2/1999 |
| JP | 2001-007738 | A | | 1/2001 |
| JP | 2003-92623 | A | | 3/2003 |
| JP | 2004-537232 | A | | 12/2004 |
| JP | 2004-537233 | A | | 12/2004 |
| JP | 2005-229433 | A | | 8/2005 |
| JP | 2005-354223 | A | | 12/2005 |
| JP | 2006-101499 | A | | 4/2006 |
| JP | 2006-340151 | A | | 12/2006 |
| JP | 2008154056 | A | * | 7/2008 |
| JP | 2008288785 | A | * | 11/2008 |
| WO | 90/10347 | A | | 9/1990 |
| WO | 03/010996 | A2 | | 2/2003 |

OTHER PUBLICATIONS

Extended Search Report issued in corresponding EP application 07706924.3, dated May 6, 2010.

Buchner, Herbert; Convention Paper 6120; Audio Engineering Society;May 8-11, 2004; pp. 1-9; AES 116th convention; Berlin Germany.

Japanese Office Action to corresponding JP 2006-023422, dated Aug. 23, 2011. English translation of Notification of Reason of Refusal provided.

* cited by examiner

AUDIO CONFERENCING APPARATUS

This is a U.S. National Phase Application of PCT International Application PCT/JP2007/050617 filed on 17 Jan. 2007, which is based on and claims priority from JP 2006-023422 filed on 31 Jan. 2006.

TECHNICAL FIELD

This invention relates to an audio conferencing apparatus for conducting an audio conference between plural points through a network etc., and particularly to an audio conferencing apparatus in which a microphone is integrated with a speaker.

BACKGROUND ART

Conventionally, a method for installing an audio conferencing apparatus every point at which an audio conference is conducted and connecting these apparatuses by a network and communicating a sound signal has often been used as a method for conducting an audio conference between remote places. Then, various audio conferencing apparatuses used in such an audio conference have been devised.

In an audio conferencing apparatus of Patent Reference 1, a sound signal input through a network is emitted from a speaker placed in a ceiling surface and a sound signal collected by each microphone placed in side surfaces using plural different directions as respective front directions is sent to the outside through the network.

In an audio conferencing apparatus of Patent Reference 2, when a talker selects a talker's microphone, a pseudo echo signal corresponding to this microphone position is generated and an emission sound diffracted and collected in the microphone is canceled and only a sound signal generated by the talker is sent to the outside through a network.

Patent Reference 1: JP-A-8-298696

Patent Reference 2: JP-A-5-158492

DISCLOSURE OF THE INVENTION

Problems that the Invention is to Solve

However, in the audio conferencing apparatus of Patent Reference 1 or Patent Reference 2, a sound is emitted from one speaker in all the orientations, so that sound emission directivity could not be controlled finely. Optimum sound emission directivity could not be set based on, for example, the number of talkers present in the periphery of the audio conferencing apparatus, that is, one person or plural persons.

In the audio conferencing apparatus of Patent Reference or Patent Reference 2, an influence of an emission sound can be eliminated at the time of sound collection, but an influence of noise other than other talker sounds cannot be eliminated effectively.

Further, in the audio conferencing apparatus as described in Patent Reference 1 or Patent Reference 2, the apparatus cannot cope properly with various sound emission and collection environments set by the number of other points connected to a network or environments (the number of conference participants, a conference room environment, etc.) of the periphery of the apparatus and a change in the sound emission and collection environments.

Therefore, an object of the invention is to provide an audio conferencing apparatus capable of speedily performing optimum sound emission and collection even in a situation in which sound emission and collection environments have various situations and these environments change.

Means for Solving the Problems

An audio conferencing apparatus of the invention is characterized by comprising a speaker array comprising plural speakers arranged in a lower surface using an outward direction from the lower surface of a housing comprising a leg portion for separating the lower surface of the housing from an installation surface at a predetermined distance as a sound emission direction, sound emission control means for performing signal processing for sound emission on an input sound signal and controlling sound emission directivity of the speaker array, a microphone array comprising plural microphones arranged in a side surface using an outward direction from the side surface of the housing as a sound collection direction, sound collection control means for performing signal processing for sound collection on a sound collection sound signal collected by the microphone array and generating plural sound collection beam signals having sound collection directivity different mutually and comparing the plural sound collection beam signals and detecting a sound collection environment and also selecting a particular sound collection beam signal and outputting the particular sound collection beam signal as an output sound signal, and regression sound elimination means for performing control so that a sound emitted from the speaker is not included in the output sound signal based on the input sound signal and the particular sound collection beam signal.

Then, it is characterized in that the regression sound elimination means of the audio conferencing apparatus of the invention generates a pseudo regression sound signal based on the input sound signal and subtracts the pseudo regression sound signal from the particular sound collection beam signal. Or, it is characterized in that the regression sound elimination means of the audio conferencing apparatus of the invention comprises comparison means for comparing a level of the input sound signal with a level of the particular sound collection beam signal, and level reduction means for reducing a level of the signal in which the comparison means decides that a signal level of the input sound signal and the particular sound collection beam signal is lower.

In these configurations, when an input sound signal is received from another audio conferencing apparatus, sound emission control means performs signal processing for sound emission such as delay control etc. so that a sound emission beam is formed by a sound emitted from each of the speakers of a speaker array. Here, the sound emission beam includes a sound beam of setting in which a sound converges at a predetermined distance in a predetermined direction of the room inside, for example, in a position in which a conference person sits, or a sound beam of setting in which a virtual point sound source is present in a certain position and a sound is emitted by diverging from this virtual point sound source. Each of the speakers emits a sound emission signal given from the sound emission control means to the room inside. Consequently, sound emission having desired sound emission directivity is implemented. A sound emitted from the speaker is reflected by an installation surface and is propagated to the talker side of a lateral direction of the apparatus.

Each of the microphones of a microphone array is installed in a side surface of a housing, and collects a sound from a direction of the side surface, and outputs a sound collection signal to sound collection control means. Thus, the speaker array and the microphone array are present in the different surfaces of the housing and thereby, a echo sound from the speaker to the microphone is reduced. The sound collection control means performs delay processing etc. with respect to each of the sound collection signals and generates plural sound collection beam signals having great directivity in a direction different from each of the directions of the side surfaces. Consequently, the echo sound is further suppressed in each of the sound collection beam signals. The sound collection control means compares signal levels etc. of each of the sound collection beam signals, and selects a particular sound collection beam signal, and outputs the particular sound collection beam signal to regression sound elimination means. The regression sound elimination means performs processing in which a sound emitted from the speaker array and diffracted to the microphone is not included in an output sound signal based on the input sound signal and the particular sound collection beam signal. Concretely, the regression sound elimination means generates a pseudo regression sound signal based on the input sound signal and subtracts the pseudo regression sound signal from the particular sound collection beam signal and thereby, a echo sound is suppressed. Or, the regression sound elimination means compares a signal level of the input sound signal with a signal level of the particular sound collection beam signal and when the signal level of the input sound signal is higher, it is decided that it is mainly receiving speech, and the signal level of the particular sound collection beam signal is reduced and when the signal level of the particular sound collection beam signal is higher, it is decided that it is mainly sending speech, and the signal level of the input sound signal is reduced.

By such a configuration, the volume of sound collection of a echo sound is reduced and a load of processing by the regression sound elimination means is reduced and also the output sound signal is optimized speedily. When the virtual point sound source is implemented by the sound emission beam, a conference having a high realistic sensation is implemented while reducing the regression sound. When the sound emission beam has a convergence property, an emission sound is controlled by the sound emission beam and a collection sound is controlled by the sound collection beam, so that the volume of sound collection of the echo sound is greatly suppressed and the load of processing by the regression sound elimination means is greatly reduced and also the output sound signal is optimized more speedily. Thus, optimum sound emission and collection are simply implemented according to conference environments such as the number of conference persons or the number of connection conference points by using the configuration of the invention.

The audio conferencing apparatus of the invention is characterized in that the housing has substantially a rectangular parallelepiped shape elongated in one direction and the plural speakers and the plural microphones are arranged along the longitudinal direction.

In this configuration, substantially an elongated rectangular parallelepiped shape is used as a concrete structure of the housing. By placing speakers and microphones in a longitudinal direction by this structure, a speaker array in which the speakers are linearly arranged and a microphone array in which the microphones are linearly arranged are efficiently placed.

The audio conferencing apparatus of the invention is characterized by comprising control means for setting the sound emission directivity based on the sound collection environment from the sound collection control means and giving the sound emission directivity to the sound emission control means.

In this configuration, sound collection control means detects a sound collection environment based on a sound collection beam. Here, the sound collection environment refers to the number of conference persons, a position (direction) of a conference person with respect to the apparatus, a talker direction, etc. Control means decides sound emission directivity based on this information. Here, the sound emission directivity refers to means for increasing a sound emission intensity in a direction of a particular conference person such as a talker or means for setting substantially the same sound emission intensity in all the conference persons. Consequently, for example, when there is one conference person (talker), a sound is emitted to only the conference person and the sound does not leak in other directions. When there are a talker and a person who only hears, a sound is equally emitted to all the conference persons.

The audio conferencing apparatus of the invention is characterized in that the control means stores a history of the sound collection environment and estimates a sound collection environment and sound emission directivity based on the history and gives the estimated sound emission directivity to the sound emission control means and also gives selection control of a sound collection beam signal according to the estimated sound collection environment to the sound collection control means.

In this configuration, the control means stores a history of a sound collection environment. For example, the past histories of the talker directions are stored. Then, in the case of detecting that there are the talker directions in only plural particular directions or there is little variation in the talker directions based on the histories, it is detected that there is the talker in only the appropriate direction, and a sound emission beam or a sound collection beam is set. For example, when the talker directions are limited to one direction, the sound emission beam or the sound collection beam is fixed in only this direction. When the talker has two directions or three directions, a sound is substantially equally emitted to all the orientations and also the talker directions are detected by only sound collection beams of these directions. Consequently, a sound is properly emitted according to the number of conference persons etc. and selection of sound collection could be made in only conference person directions and a load of processing is reduced.

The audio conferencing apparatus of the invention is characterized in that the control means detects the number of input sound signals and sets the sound emission directivity based on the sound collection environment and the number of input sound signals.

In this configuration, the control means detects the number of input sound signals and detects the number of audio conferencing apparatuses participating in a conference through a network from this number detected. Then, sound emission directivity is set according to the number of audio conferencing apparatuses connected. Concretely, when the number of audio conferencing apparatus connections is one and a conference person corresponds one-to-one with the audio conferencing apparatus, a virtual point sound source is not particularly required and the convergent sound emission described above is performed and a sound is emitted to only the conference person. Contrary to this, when there are plural conference persons using one audio conferencing apparatus, a virtual point sound source is set in substantially the center position of the audio conferencing apparatus and a sound is emitted. On the other hand, when the number of audio conferencing apparatus connections is plural, for example, plural virtual point sound sources are set and a sound having a high realistic sensation is emitted or an emission sound is converged in directions different every connection destination as described below.

The audio conferencing apparatus of the invention is characterized in that the control means stores a history of the sound collection environment and a history of the input sound signal and detects association between a change in a sound collection environment and an input sound signal based on both the histories and gives sound emission directivity estimated based on the association to the sound emission control means and also gives selection control of a sound collection beam signal according to the estimated sound collection environment to the sound collection control means.

In this configuration, the control means stores a history of the sound collection environment and a history of the input sound signal, that is, a history of a connection destination, and detects association between these histories. For example, information in which a talker present in a first direction with respect to the apparatus converses with a first connection destination and a talker present in a second direction with respect to the apparatus converses with a second connection destination is acquired. Then, the control means sets convergent sound emission directivity every input sound signal (connection destination) so as to emit a sound to only the corresponding talker. The control means sets sound collection beam selection (sound collection directivity) every output sound signal (connection destination) so as to collect a sound in only the corresponding talker direction. Consequently, plural audio conferences are implemented in parallel by one audio conferencing apparatus and mutual conference sounds do not interfere.

EFFECT OF THE INVENTION

According to the invention, an optimum audio conference can be implemented by the only one audio conferencing apparatus with respect to environments or forms of various audio conferences by the number of conference persons using one audio conferencing apparatus, the number of points participating in an audio conference, etc.

BEST MODE FOR CARRYING OUT THE INVENTION

An audio conferencing apparatus according to an embodiment of the invention will be described with reference to the drawings.

Figure 1A:
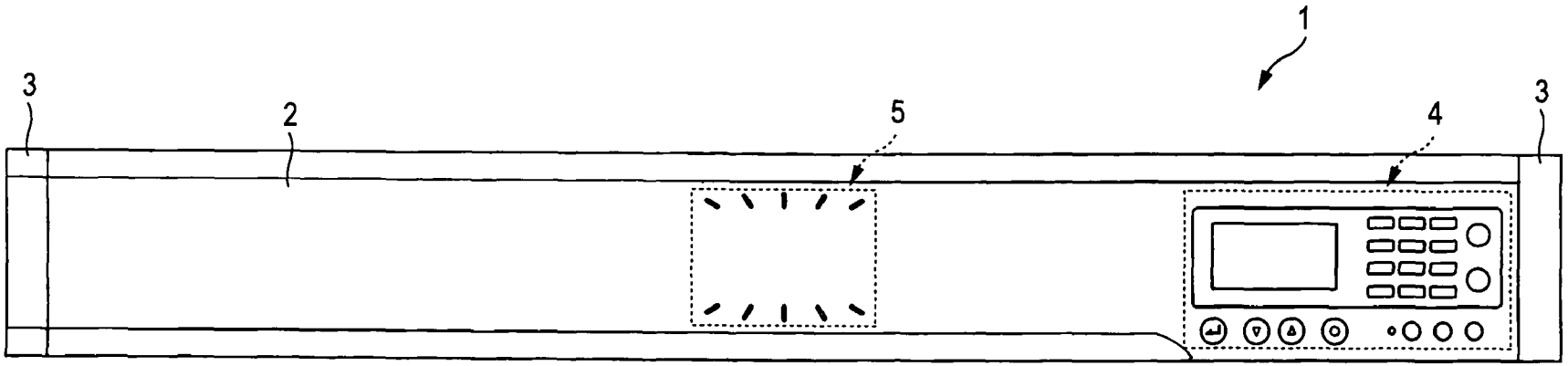
FIG. 1A is a plan diagram representing an audio conferencing apparatus of the invention.
Figure 1B:
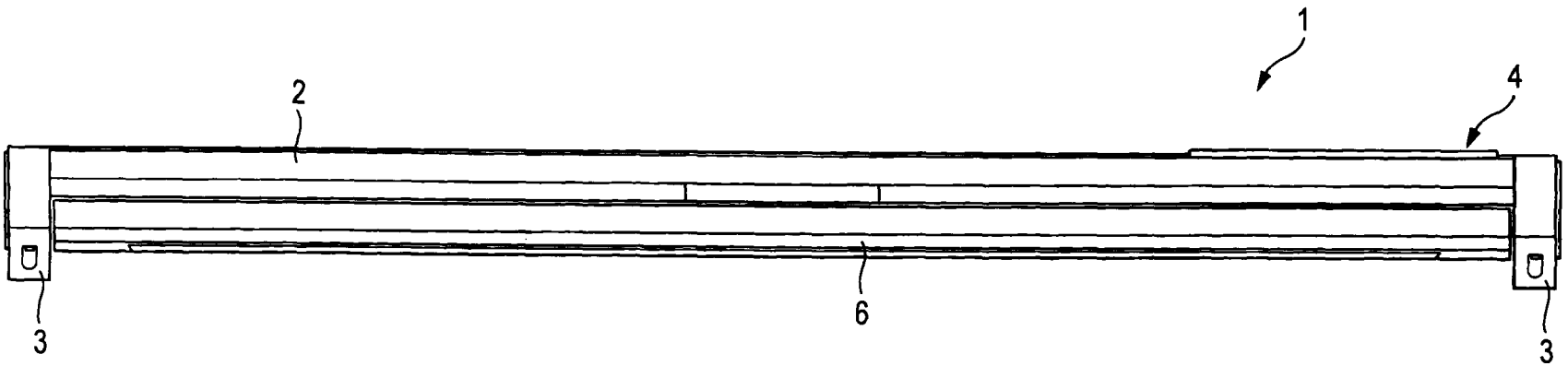
FIG. 1B is a front diagram representing the audio conferencing apparatus of the invention.
Figure 1C:
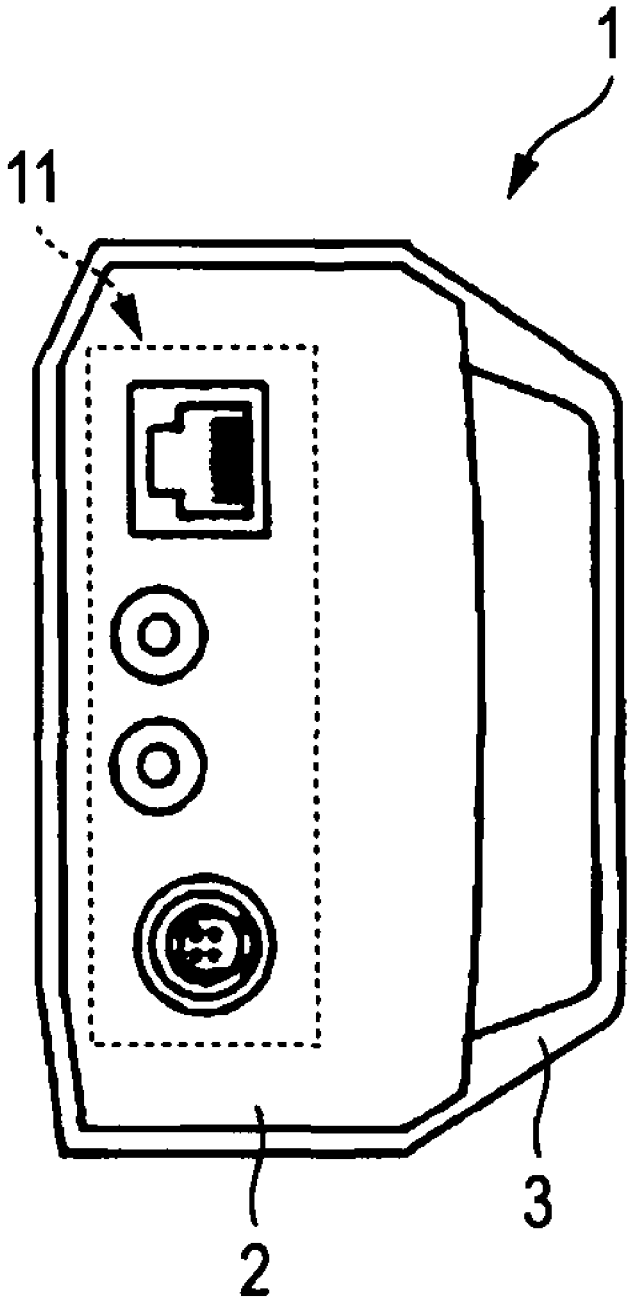
FIG. 1C is a side diagram representing the audio conferencing apparatus of the invention.

FIGS. 1A to 1C are three-view drawings representing the audio conferencing apparatus of the present embodiment, and FIG. 1A is a plan diagram, and FIG. 1B is a front diagram (diagram viewed from the side of a longitudinal side surface), and FIG. 1C is a side diagram (diagram viewed from a side surface of the short-sized side).

Figure 2A:
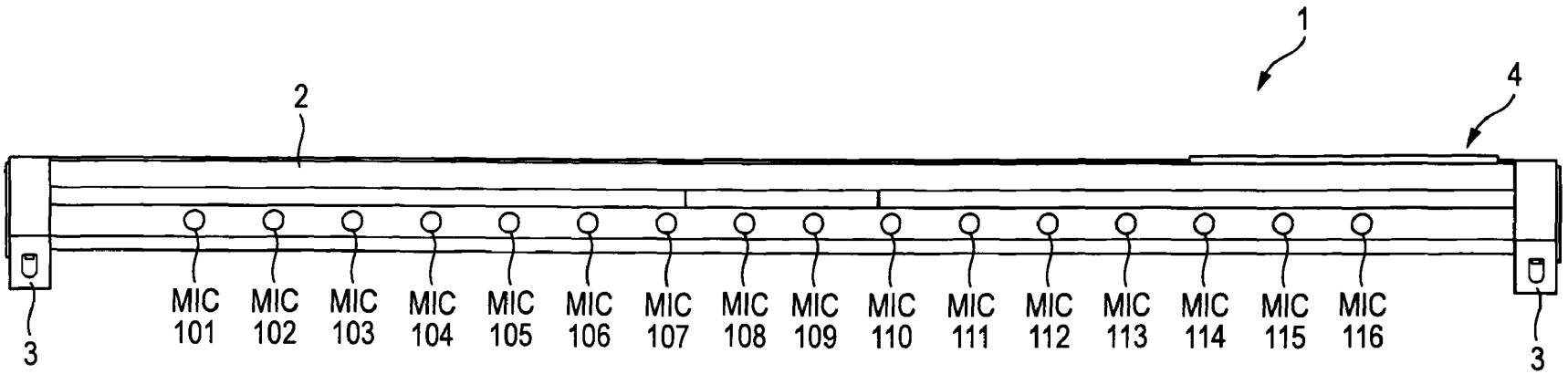
FIG. 2A is a front diagram showing microphone arrangement and speaker arrangement of the audio conferencing apparatus shown in FIG. 1A.
Figure 2B:
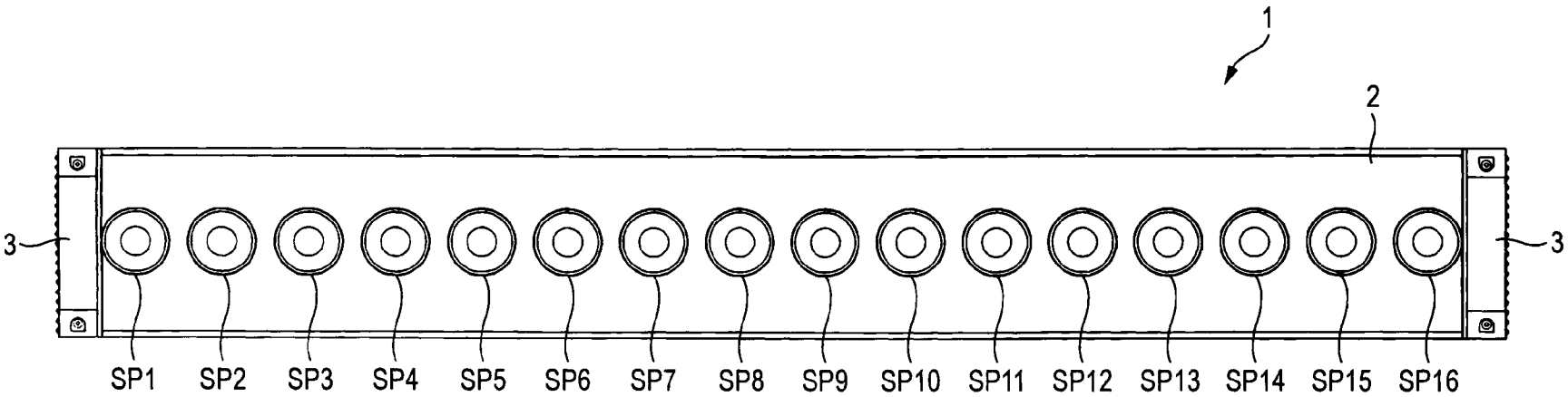
FIG. 2B is a bottom diagram showing the microphone arrangement and the speaker arrangement of the audio conferencing apparatus shown in FIG. 1B.
Figure 2C:
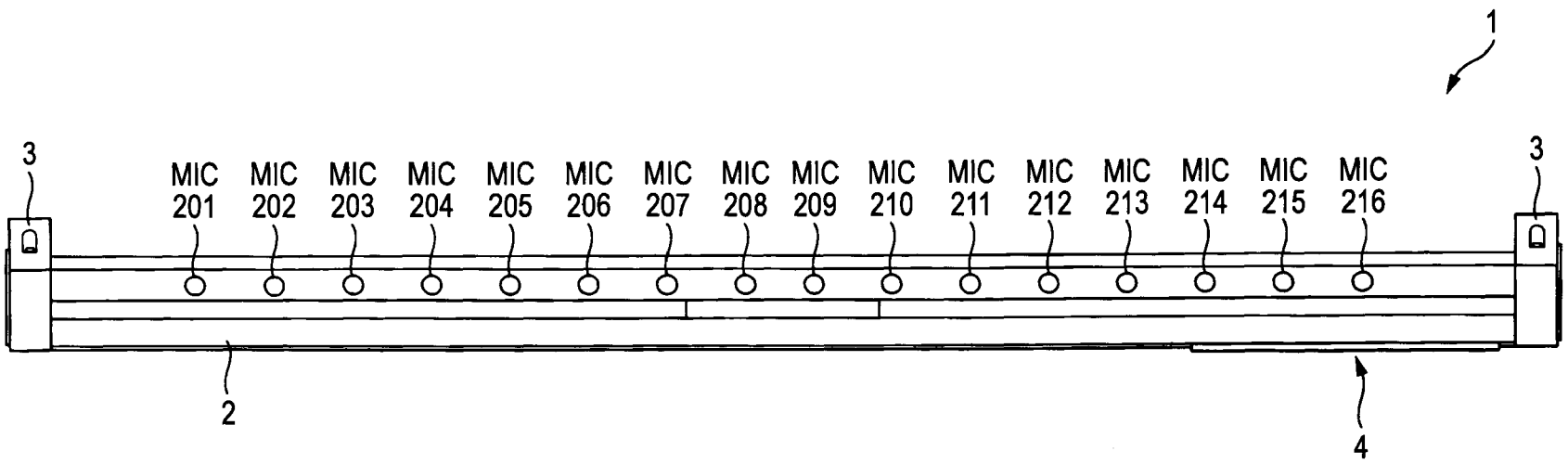
FIG. 2C is a back diagram showing the microphone arrangement and the speaker arrangement of the audio conferencing apparatus shown in FIG. 1C.

FIGS. 2A to 2C are diagrams showing microphone arrangement and speaker arrangement of the audio conferencing apparatus shown in FIGS. 1A to 1C, and FIG. 2A is a front diagram (corresponding to FIG. 1B), and FIG. 2B is a bottom diagram, and FIG. 2C is a back diagram (corresponding to a surface opposite to FIG. 1B).

Figure 3:
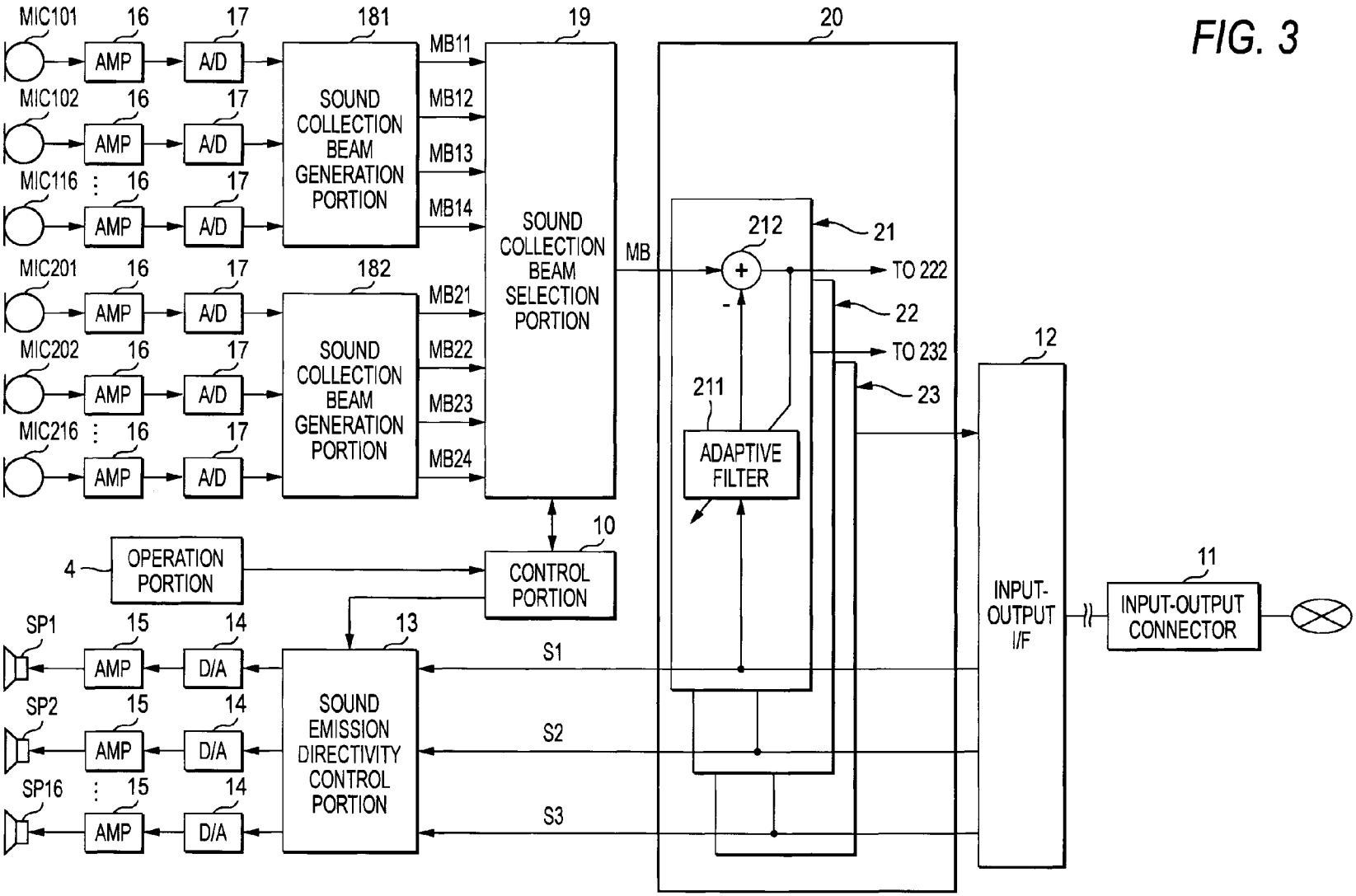
FIG. 3 is a functional block diagram of the audio conferencing apparatus of the invention.

FIG. 3 is a functional block diagram of the audio conferencing apparatus of the embodiment.

As shown in FIGS. 1A to 2C, the audio conferencing apparatus 1 of the embodiment mechanistically comprises a housing 2, leg portions 3, an operation portion 4, a light-emitting portion 5, and an input-output connector 11.

The housing 2 is made of substantially a rectangular parallelepiped shape elongated in one direction, and the leg portions 3 with predetermined heights for separating a lower surface of the housing 2 from an installation surface at a predetermined distance are installed in both ends of longitudinal sides (surfaces) of the housing 2. In addition, in the following description, a surface having a long-size among four side surfaces of the housing 2 is called a longitudinal surface and a surface having a short size among the four side surfaces is called a short-sized surface.

The operation portion 4 made of plural buttons or a display screen is installed in one end of a longitudinal direction in an upper surface of the housing 2. The operation portion 4 is connected to a control portion 10 installed inside the housing 2 and accepts an operation input from a conference person and outputs the input to the control portion 10 and also displays the contents of operation, an execution mode, etc. on the display screen. The light-emitting portion 5 made of light-emitting elements such as LEDs radially placed using one point as the center is installed in the center of the upper surface of the housing 2. The light-emitting portion 5 emits light according to light emission control from the control portion 10. For example, when light emission control indicating a talker direction is input, light of the light-emitting element corresponding to its direction is emitted.

The input-output connector 11 comprising a LAN interface, an analog audio input terminal, an analog audio output terminal and a digital audio input-output terminal is installed in the short-sized surface of the side in which the operation portion 4 in the housing 2 is installed, and this input-output connector 11 is connected to an input-output I/F 12 installed inside the housing 2. By attaching a network cable to the LAN interface and making connection to a network, connection to other audio conferencing apparatus on the network is made.

Speakers SP1 to SP16 with the same shape are installed in the lower surface of the housing 2. These speakers SP1 to SP16 are linearly installed along a longitudinal direction at a constant distance and thereby, a speaker array is constructed. Microphones MIC101 to MIC116 with the same shape are installed in one longitudinal surface of the housing 2. These microphones MIC101 to MIC116 are linearly installed along the longitudinal direction at a constant distance and thereby, a microphone array is constructed. Microphones MIC201 to MIC216 with the same shape are installed in the other longitudinal surface of the housing 2. These microphones MIC201 to MIC216 are also linearly installed along the longitudinal direction at a constant distance and thereby, a microphone array is constructed. Then, a lower surface grille 6 which is punched and meshed and is formed in a shape of covering the speaker array and the microphone arrays is installed in the lower surface side of the housing 2. In addition, in the embodiment, the number of speakers of the speaker array is set at 16 and the number of microphones of each of the microphone arrays is respectively set at 16, but are not limited to this, and the number of speakers and the number of microphones could be set properly according to specifications. The distances of the speaker array and the microphone array may be not constant and, for example, a form of being closely placed in the center along the longitudinal direction and being loosely placed toward both ends may be used.

Next, the audio conferencing apparatus 1 of the embodiment functionally comprises the control portion 10, the input-output connector 11, the input-output I/F 12, a sound emission directivity control portion 13, D/A converters 14, amplifiers 15 for sound emission, the speaker array (speakers SP1 to SP16), the microphone arrays (microphones MIC101 to MIC116, microphones MIC201 to MIC216), amplifiers 16 for sound collection, A/D converters 17, a sound collection beam generation portion 181, a sound collection beam generation portion 182, a sound collection beam selection portion 19, an echo cancellation portion 20, and the operation portion 4 as shown in FIG. 3.

The input-output I/F 12 converts an input sound signal from another audio conferencing apparatus input through the input-output connector 11 from a data format (protocol) corresponding to a network, and gives the sound signal to the sound emission directivity control portion 13 through the echo cancellation portion 20. In this case, when input sound signals are received from plural audio conferencing apparatuses, the input-output I/F 12 identifies these sound signals every audio conferencing apparatus and gives the sound signals to the sound emission directivity control portion 13 through the echo cancellation portion 20 by respectively different transmission paths. The input-output I/F 12 converts an output sound signal generated by the echo cancellation portion 20 into a data format (protocol) corresponding to a network, and sends the output sound signal to the network through the input-output connector 11.

Based on specified sound emission directivity, the sound emission directivity control portion 13 performs amplitude processing and delay processing, etc. respectively specific to each of the speakers SP1 to SP16 of the speaker array with respect to the input sound signals and generates individual sound emission signals. Here, the sound emission directivity includes directivity for converging an emission sound in a predetermined position in the longitudinal direction of the audio conferencing apparatus 1 or directivity for setting a virtual point sound source and outputting an emission sound from the virtual point sound source, and the individual sound emission signals in which the directivity is implemented by the emission sounds from the speakers SP1 to SP16 are generated.

Then, the sound emission directivity control portion 13 outputs these individual sound emission signals to the D/A converters 14 installed every speakers SP1 to SP16. Each of the D/A converters 14 converts the individual sound emission signal into an analog format and outputs the signal to each of the amplifiers 15 for sound emission, and each of the amplifiers 15 for sound emission amplifies the individual sound emission signal and gives the signal to the speakers SP1 to SP16.

The speakers SP1 to SP16 are made of non-directional speakers and make sound conversion of the given individual sound emission signals and emit sounds to the outside. In this case, the speakers SP1 to SP16 are installed in the lower surface of the housing 2, so that the emitted sounds are reflected by an installation surface of a desk on which the audio conferencing apparatus 1 is installed, and are propagated from the side of the apparatus in which a conference person is present toward the oblique upper portion.

Each of the microphones MIC101 to MIC116 and MIC201 to MIC216 of the microphone arrays may be non-directional or directional, but it is desirable to be directional, and a sound from the outside of the audio conferencing apparatus 1 is collected and electrical conversion is made and a sound collection signal is output to each of the amplifiers 16 for sound collection. Each of the amplifiers 16 for sound collection amplifies the sound collection signal and respectively gives the signals to the A/D converters 17, and the A/D converters 17 make digital conversion of the sound collection signals and output the signals to the sound collection beam generation portions 181, 182. Here, sound collection signals in the microphones MIC101 to MIC116 installed on one longitudinal surface are input to the sound collection beam generation portion 181, and sound collection signals in the microphones MIC201 to MIC216 installed on the other longitudinal surface are input to the sound collection beam generation portion 182.

Figure 4:
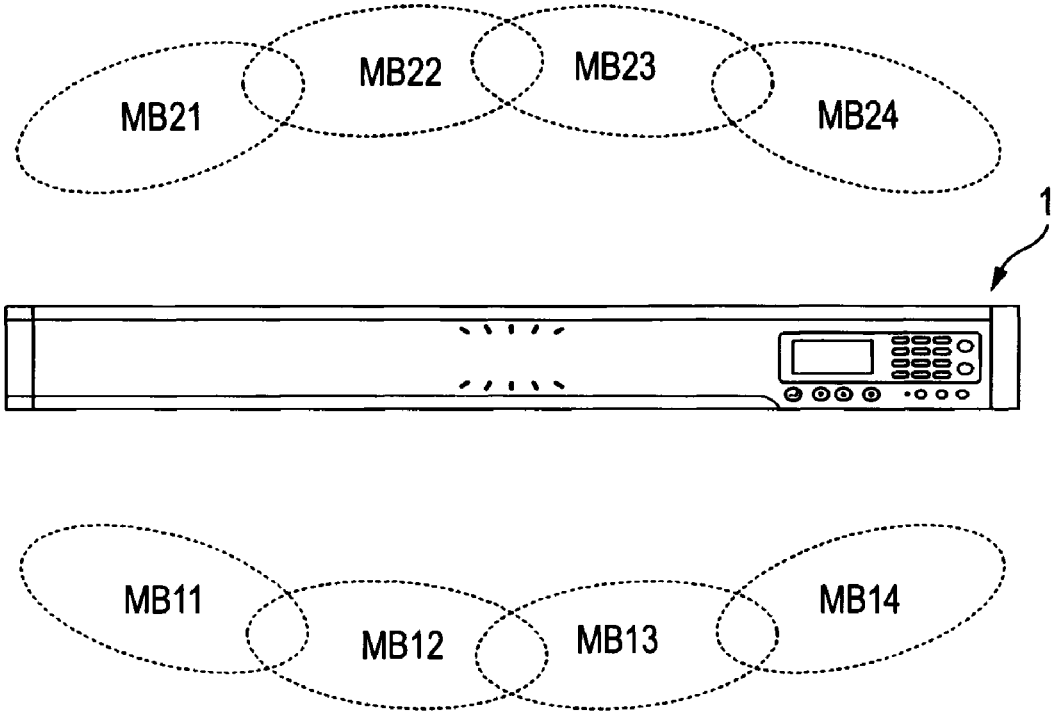
FIG. 4 is a plan diagram showing distribution of sound collection beams MB11 to MB14 and MB21 to MB24 of the audio conferencing apparatus 1 of the invention.

FIG. 4 is a plan diagram showing distribution of sound collection beams MB11 to MB14 and MB21 to MB24 of the audio conferencing apparatus 1 according to the embodiment.

The sound collection beam generation portion 181 performs predetermined delay processing etc. with respect to the sound collection signals of each of the microphones MIC101 to MIC116 and generates sound collection beam signals MB11 to MB14. In the longitudinal surface side in which the microphones MIC101 to MIC116 are installed, different predetermined regions for the sound collection beam signals MB11 to MB14 are respectively set as the centers of sound collection intensities along the longitudinal surface.

The sound collection beam generation portion 182 performs predetermined delay processing etc. on the sound collection signals of each of the microphones MIC201 to MIC216 and generates sound collection beam signals MB21 to MB24. In the longitudinal surface side in which the microphones MIC201 to MIC216 are installed, different predetermined regions for the sound collection beam signals MB21 to MB24 are respectively set as the centers of sound collection intensities along the longitudinal surface.

The sound collection beam selection portion 19 inputs the sound collection beam signals MB11 to MB14 and MB21 to MB24 and compares signal intensities and selects the sound collection beam signal MB compliant with a predetermined condition preset. For example, when only a sound from one talker is sent to another audio conferencing apparatus, the sound collection beam selection portion 19 selects a sound collection beam signal with the highest signal intensity and outputs the beam signal to the echo cancellation portion 20 as a particular sound collection beam signal MB. When plural sound collection beam signals are required in the case of conducting plural audio conferences in parallel, sound collection beam signals according to its situation are sequentially selected and the respective sound collection beam signals are output to the echo cancellation portion 20 as individual particular sound collection beam signals MB. The sound collection beam selection portion 19 outputs sound collection environment information including a sound collection direction (sound collection directivity) corresponding to the selected particular sound collection beam signal MB to the control portion 10. Based on this sound collection environment information, the control portion 10 pinpoints a talker direction and sets sound emission directivity given to the sound emission directivity control portion 13.

The echo cancellation portion 20 is made of a structure in which respectively independent echo cancellers 21 to 23 are installed and these echo cancellers are connected in series. That is, an output of the sound collection beam selection portion 19 is input to the echo canceller 21 and an output of the echo canceller 21 is input to the echo canceller 22. Then, an output of the echo canceller 22 is input to the echo canceller 23 and an output of the echo canceller 23 is input to the input-output I/F 12.

The echo canceller 21 comprises an adaptive filter 211 and a postprocessor 212. The echo cancellers 22, 23 have the same configuration as that of the echo canceller 21, and respectively comprise adaptive filters 221, 231 and postprocessors 222, 232 (not shown).

The adaptive filter 211 of the echo canceller 21 generates a pseudo regression sound signal based on sound collection directivity of the particular sound collection beam signal MB selected and sound emission directivity set for an input sound signal S1. The postprocessor 212 subtracts the pseudo regression sound signal for the input sound signal S1 from the particular sound collection beam signal output from the sound collection beam selection portion 19, and outputs it to the postprocessor 222 of the echo canceller 22.

The adaptive filter 221 of the echo canceller 22 generates a pseudo regression sound signal based on sound collection directivity of the particular sound collection beam signal MB selected and sound emission directivity set for an input sound signal S2. The postprocessor 222 subtracts the pseudo regression sound signal for the input sound signal S2 from a first subtraction signal output from the postprocessor 212 of the echo canceller 21, and outputs it to the postprocessor 232 of the echo canceller 23.

The adaptive filter 231 of the echo canceller 23 generates a pseudo regression sound signal based on sound collection directivity of the particular sound collection beam signal MB selected and sound emission directivity set for an input sound signal S3. The postprocessor 232 subtracts the pseudo regression sound signal for the input sound signal S3 from a second subtraction signal output from the postprocessor 222 of the echo canceller 22, and outputs the pseudo regression sound signal to the input-output I/F 12 as an output sound signal. Here, any one of the echo cancellers 21 to 23 operates when the input sound signal is one signal, and any two of the echo cancellers 21 to 23 operate when the input sound signal is two signals.

By performing such echo cancellation processing, proper echo elimination is performed and only a talker's sound of the talker's apparatus is sent to a network as an output sound signal. In this case, the echo cancellation processing is performed after sound emission beam processing and sound collection beam processing are performed, so that a echo sound can be suppressed as compared with the case of comprising a non-directional microphone or the case of comprising a non-directional speaker simply. Further, since it has a structure in which echo is resistant to occurring between a microphone and a speaker as described above mechanistically, an effect of suppressing the echo sound improves more and also occurrence of the echo is mechanistically small, so that a processing load of the echo cancellation processing reduces and an optimum output sound signal can be generated at higher speed.

Next, an example of use of the audio conferencing apparatus for performing the processing and such a configuration will be described with reference to the drawings. In addition, the following examples are a part of the use methods, and the processing and the configuration of the invention can also be applied to a use method similar to these examples.

(1) The Case where the Number of Other Audio Conferencing Apparatuses Connected Through a Network is One When the number of other audio conferencing apparatuses connected is one, that is, an audio conference is conducted in a one-to-one correspondence between the audio conferencing apparatuses, the number of input sound signals received by the input-output I/F 12 is one, and the control portion 10 detects this signal and detects that the number of other audio conferencing apparatuses is one.

As normal processing different from detection of this input sound signal, the sound collection beam selection portion 19 selects the particular sound collection beam signal from each of the sound collection beam signals and also generates sound collection environment information as described above. The control portion 10 acquires the sound collection environment information and detects a talker direction and performs predetermined sound emission directivity control. For example, in the case of making setting in which an emission sound is converged on a talker and the emission sound is not propagated in other regions, the sound emission directivity control of forming a sound emission beam signal converged on the detected talker direction is performed. Consequently, even in the case of conducting a conference inside space in which many persons who are not involved in the conference are present randomly, only a sound from a talker is collected at a high S/N ratio and also a sound of an opponent conference person is emitted to only the talker and this sound can be prevented from leaking to other persons.

By the way, in this method, when there are plural conference persons, only a talker can hear a sound of an opponent conference person.

Therefore, in such a case, the sound emission directivity could be controlled by another method.

Figure 5A:
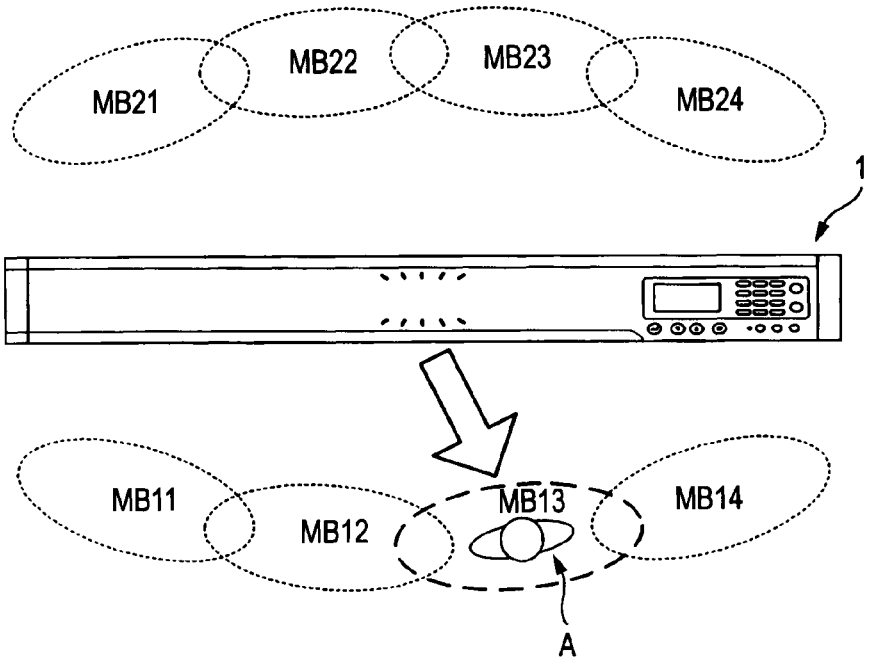
FIG. 5A is a diagram showing the case where one conference person A conducts a conference in the audio conferencing apparatus 1.
Figure 5B:
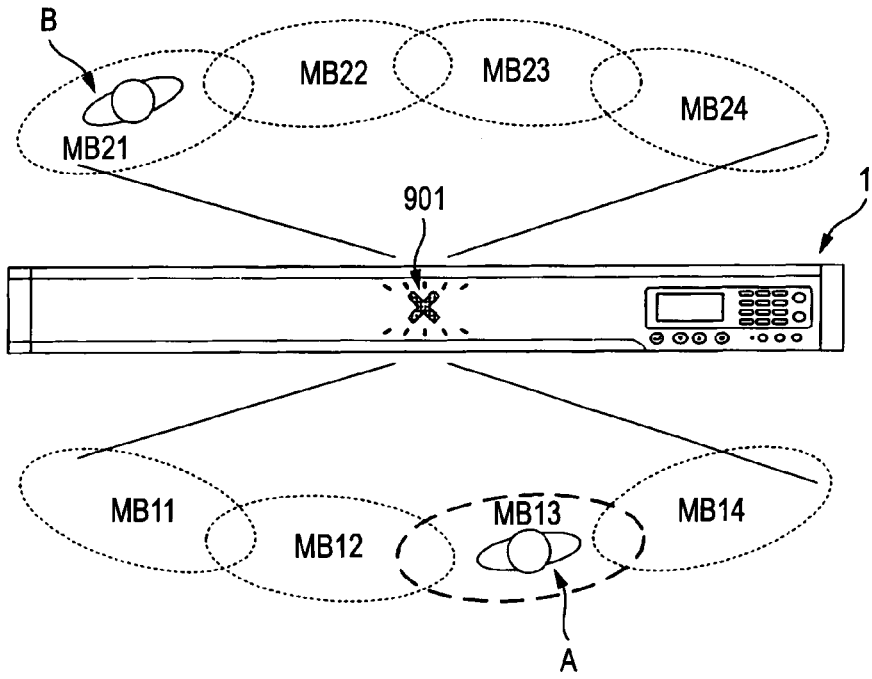
FIG. 5B is a diagram showing the case where two conference persons A, B conduct a conference in the audio conferencing apparatus 1 and the conference person A becomes a talker.

FIG. 5A is a diagram showing the case where one conference person A conducts a conference in the audio conferencing apparatus 1, and FIG. 5B is a diagram showing the case where two conference persons A, B conduct a conference in the audio conferencing apparatus 1 and the conference person A becomes a talker.

As shown in FIG. 5A, when one conference person is A, the conference person A becomes a talker naturally. The sound collection beam selection portion 19 selects a sound collection beam signal MB13 using a direction of the presence of the conference person A as the center of directivity from sound collection signals, and gives this sound collection environment information to the control portion 10. The control portion 10 detects a direction of the talker. Then, the control portion 10 sets sound emission directivity for emitting a sound in only the direction of the talker A detected as shown in FIG. 5A. Consequently, a sound of an opponent conference person is emitted to only the talker A and the conference sound can be prevented from propagating (leaking) in other regions.

On the other hand, when two conference persons are A and B, the conference person A becomes a talker as shown in FIG. 5B, the sound collection beam selection portion 19 selects a sound collection beam signal MB13 using a direction of the presence of the conference person A as the center of directivity, and gives this sound collection environment information to the control portion 10. The control portion 10 detects a direction of the talker and also stores a talker direction detected before this talker direction and reads out its talker direction and detects the talker direction as a conference person direction. In an example of FIG. 5B, a direction of the conference person B is detected as the conference person direction.

Then, the control portion 10 sets sound emission directivity in which a virtual point sound source 901 is positioned in the center of a longitudinal direction of the audio conferencing apparatus 1 so as to equally emit a sound in the direction of the conference person B and the direction of the talker A detected as shown in FIG. 5B. Consequently, a sound of an opponent conference person can be equally emitted to the conference person B as well as the talker A at that point in time.

By switching sound emission directivity while switching sound collection directivity (particular sound collection beam signal) according to switching of a talker thus, an audio conference in which it is easy to hear a sound to all the mutual conference persons can be implemented. Then, the present apparatus can easily conduct this audio conference by simultaneously comprising a speaker array and a microphone array.

In addition, as described above, the control portion 10 stores the talker directions and thereby, the control portion 10 reads out the talker directions within a predetermined period before that point in time and can detect the talker direction set mainly. When the control portion 10 detects that this talker direction is limited, the control portion 10 instructs the sound collection beam selection portion 19 to perform selection processing by only a corresponding sound collection beam signal. The sound collection beam selection portion 19 performs the selection processing by only the corresponding sound collection beam signal according to this instruction and produces an output to the echo cancellation portion 20. For example, in the case of collecting a talker sound from only one direction always, it is fixed in a sound collection beam signal of this one direction and in the case of collecting a sound of a talker direction in only two directions, selection processing is performed by only sound collection beam signals of these two directions. By performing such processing, a load of the sound collection beam selection processing is reduced and an output sound signal can be generated more speedily.

(2) The Case where the Number of Other Audio Conferencing Apparatuses Connected Through a Network is Plural When the number of other audio conferencing apparatuses connected is plural, the number of input sound signals received by the input-output I/F 12 is plural, and the control portion 10 detects this signal and detects that the number of other audio conferencing apparatuses is plural. Then, the control portion 10 sets respectively different positions for each of the audio conferencing apparatuses in virtual point sound sources, and sets sound emission directivity in which each of the input sound signals utters and diverges from the respective virtual point sound sources.

Figure 6A:
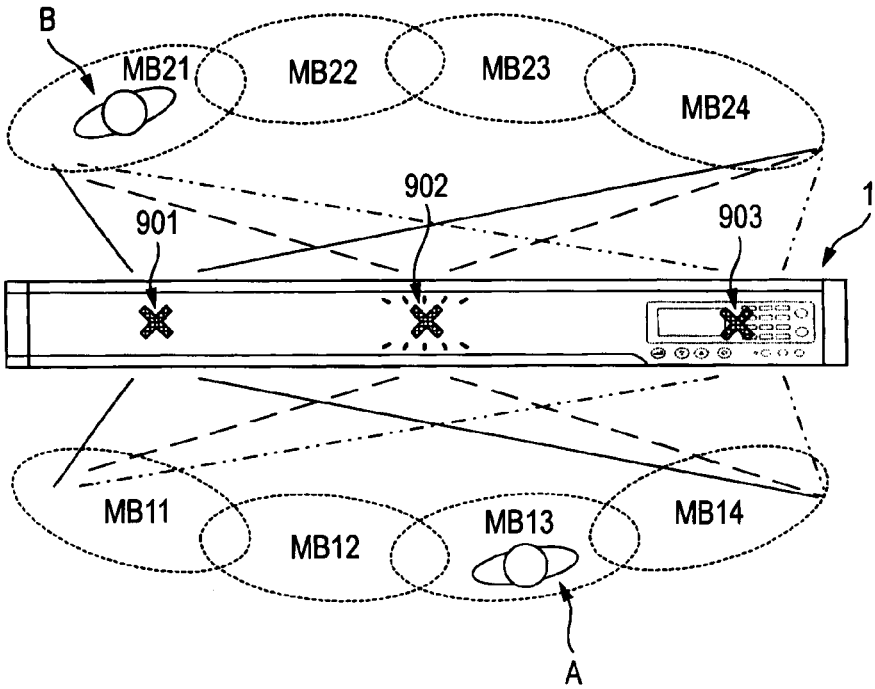
FIG. 6A is a conceptual diagram showing a sound emission situation of the case of setting three virtual point sound sources.
Figure 6B:
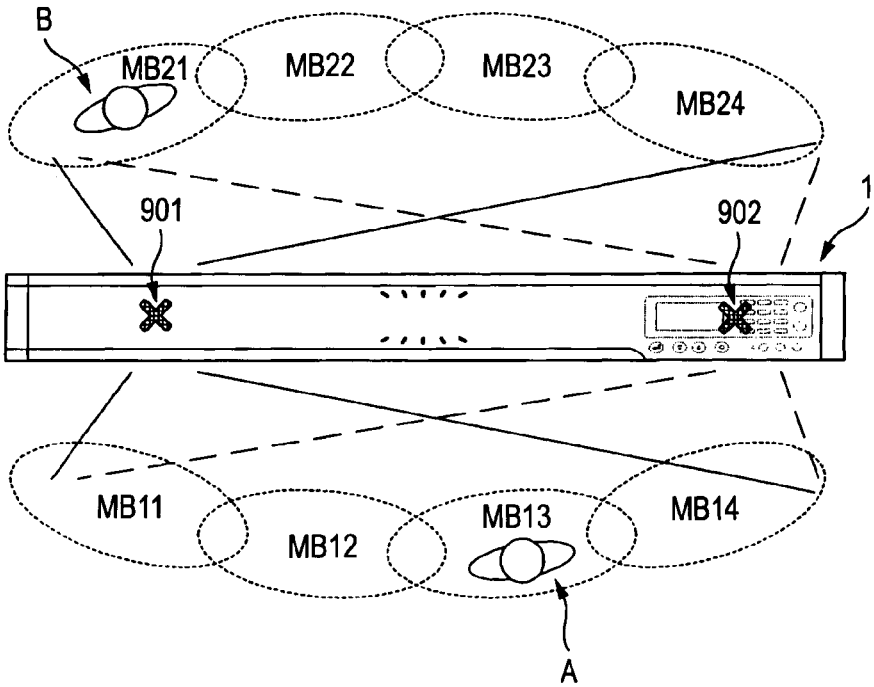
FIG. 6B is a conceptual diagram showing a sound emission situation of the case of setting two virtual point sound sources.

FIG. 6A is a conceptual diagram showing a sound emission state of the case of setting three virtual point sound sources. FIG. 6B is a conceptual diagram showing a sound emission state of the case of setting two virtual point sound sources. In FIGS. 6A and 6B, a solid line shows an emission sound from a virtual point sound source 901 and a broken line shows an emission sound from a virtual point sound source 902 and a two-dot chain line shows an emission sound from a virtual point sound source 903.

For example, when there are three input sound signals, the virtual point sound sources 901, 902, 903 according to the respective input sound signals are set as shown in FIG. 6A. In this case, the virtual point sound sources 901, 903 are associated with both the opposed ends of a longitudinal direction of the housing 1 and the virtual point sound source 902 is associated with the center of the longitudinal direction of the housing 1. Based on this setting, sound emission directivity is set and an individual sound emission signal of each of the speakers SP1 to SP16 is generated by delay control and amplitude control, etc. in the sound emission directivity control portion 13. Then, the speakers SP1 to SP16 emit the individual sound emission signals and thereby, a state of respectively uttering sounds from the virtual point sound sources 901 to 903 of three different places can be formed. On the other hand, when there are two input sound signals, the virtual point sound sources 901, 902 according to the respective input sound signals are set as shown in FIG. 6B. In this case, the virtual point sound sources 901, 902 are associated with both the opposed ends of a longitudinal direction of the housing 1. Based on this setting, sound emission directivity is set and thereby, a state of respectively uttering sounds from the virtual point sound sources 901, 902 of two different places can be formed in turn. In addition, positions of these virtual point sound sources may be preset in fixed positions.

Since these switching can be performed by only switching of sound emission directivity setting of the control portion 10, an optimum sound emission environment (sound emission directivity) can easily be achieved according to the number of other audio conferencing apparatuses connected, that is, a connection environment. Then, a conference having a higher realistic sensation can be conducted by setting such virtual point sound sources. In addition, in this case, an emission sound diverges, so that a regression sound can effectively be eliminated by previously giving an initial parameter for virtual point sound source to the echo cancellation portion 20 though the emission sound is somewhat collected.

(3) The Case of Simultaneously Conducting Plural Different Conferences

When the number of other audio conferencing apparatuses connected is plural, the number of input sound signals received by the input-output I/F 12 is plural, and the control portion 10 detects this signal and detects that the number of other audio conferencing apparatuses is plural. The control portion 10 detects and stores a signal intensity of each of the input sound signals and detects a history of each of the input sound signals. Here, the history of the input sound signal is a history detected whether or not to have a predetermined signal intensity, and corresponds to the fact as to whether conversation is actually conducted. At the same time, the control portion 10 detects a history of a talker direction based on sound collection environment information stored. The control portion 10 compares the history of the input sound signal with the history of the talker direction and detects a correlation between the input sound signal and the talker direction.

Figure 7:
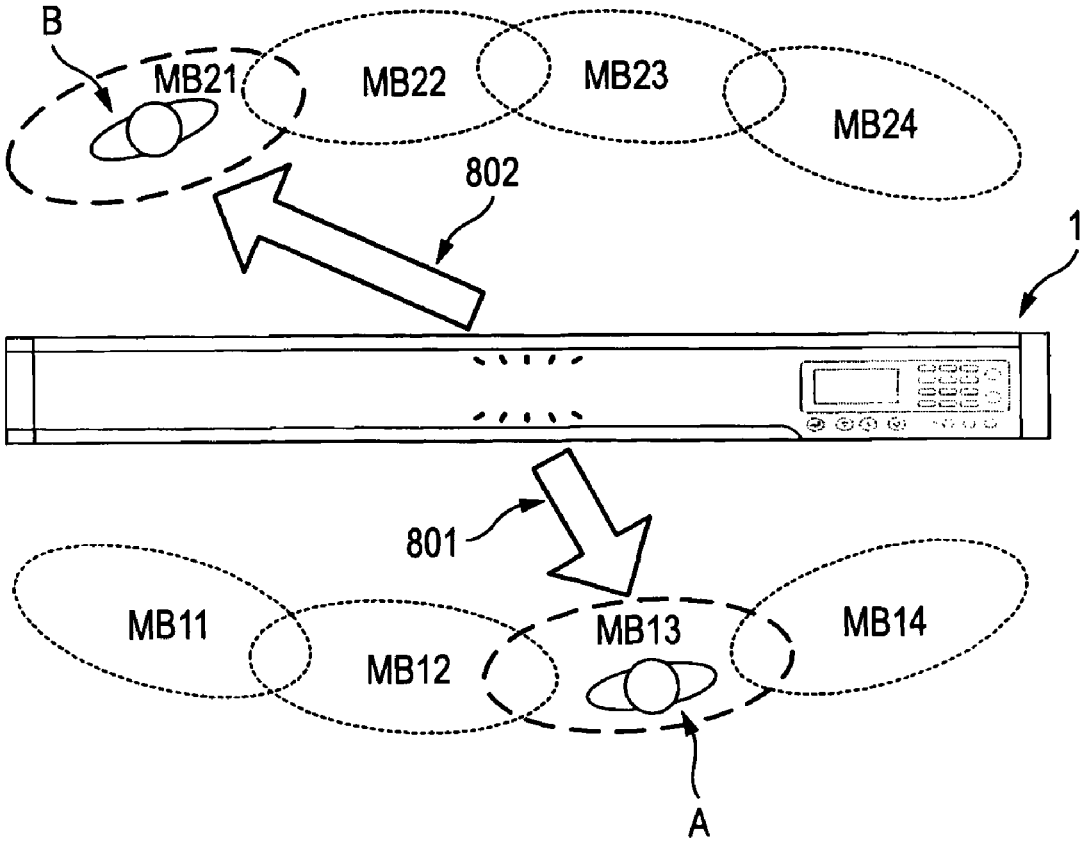
FIG. 7 is a diagram showing a situation in which two conference persons A, B respectively conduct conversation between different audio conferencing apparatuses.

FIG. 7 is a diagram showing a situation in which two conference persons A, B respectively conduct conversation with a different audio conferencing apparatus using one audio conferencing apparatus 1, and block arrows of FIG. 7 show sound emission beams 801, 802. Then, FIG. 7 shows the case where the conference person A converses with an audio conferencing apparatus corresponding to an input sound signal S1 and the conference person B converses with another audio conferencing apparatus corresponding to an input sound signal S2.

For example, in the case as shown in FIG. 7, the conference person A utters a sound in a form of responding to sound emission by the input sound signal S1 and the conference person B utters a sound in a form of responding to sound emission by the input sound signal S2. In such a situation, a signal intensity of a sound collection beam signal MB13 becomes high at approximately the same time as the end of a period during which the input sound signal S1 has a predetermined signal intensity. Then, the signal intensity of the input sound signal S1 again becomes high at approximately the same time as the case where the signal intensity of the sound collection beam signal MB13 becomes low. Similarly, a signal intensity of a sound collection beam signal MB21 becomes high at approximately the same time as the end of a period during which the input sound signal S2 has a predetermined signal intensity. Then, the signal intensity of the input sound signal S2 again becomes high at approximately the same time as the case where the signal intensity of the sound collection beam signal MB21 becomes low. The control portion 10 detects a change in this signal intensity and associates the input sound signal S1 with the conference person A and associates the input sound signal S2 with the conference person B. Then, the control portion 10 sets sound emission directivity in which the input sound signal S1 is emitted to only the conference person A and the input sound signal S2 is emitted to only the conference person B. As a result of this, a sound from an opponent of the side of the conference person A cannot hear the conference person B and a sound from an opponent of the side of the conference person B cannot hear the conference person A.

On the other hand, the control portion 10 instructs the sound collection beam selection portion 19 to perform selection processing of a sound collection beam signal every sound collection beam signal group respectively corresponding to each of the input sound signals S1, S2. In an example of FIG. 7, the sound collection beam selection portion 19 performs the selection processing described above on sound collection beam signals MB11 to MB14 by microphones MIC101 to MIC116 of the side in which the conference person A is present and also, performs the selection processing described above on sound collection beam signals MB21 to MB24 by microphones MIC201 to MIC216 of the side in which the conference person B is present. Then, the sound collection beam selection portion 19 outputs the respectively selected sound collection beam signals to the echo cancellation portion 20 as particular sound collection beam signals respectively corresponding to the input sound signals S1, S2. In the echo cancellation portion 20, echo cancellation processing of the particular sound collection beam signals corresponding to each of the conference persons A, B is sequentially performed and output sound signals are generated and in the input-output I/F 12, data for specifying sending destinations are attached to the respective output sound signals. Consequently, an utterance sound of the conference person A is not sent to an opponent of the side of the conference person B, and an utterance sound of the side of the conference person B is not sent to an opponent of the side of the conference person A. Consequently, the conference persons A, B can individually conduct audio communication with a conference person of the other audio conferencing apparatus side different mutually while using the same audio conferencing apparatus 1 and further can conduct conferences in parallel without interfering mutually. Then, such plural conferences in parallel can easily be implemented by using the configuration of the embodiment.

In addition, in each of the examples described above, the form in which the control portion 10 automatically makes sound emission and sound collection settings is shown, but it may be constructed so that the operation portion 4 is operated and a conference person manually makes sound emission and sound collection settings.

Figure 8:
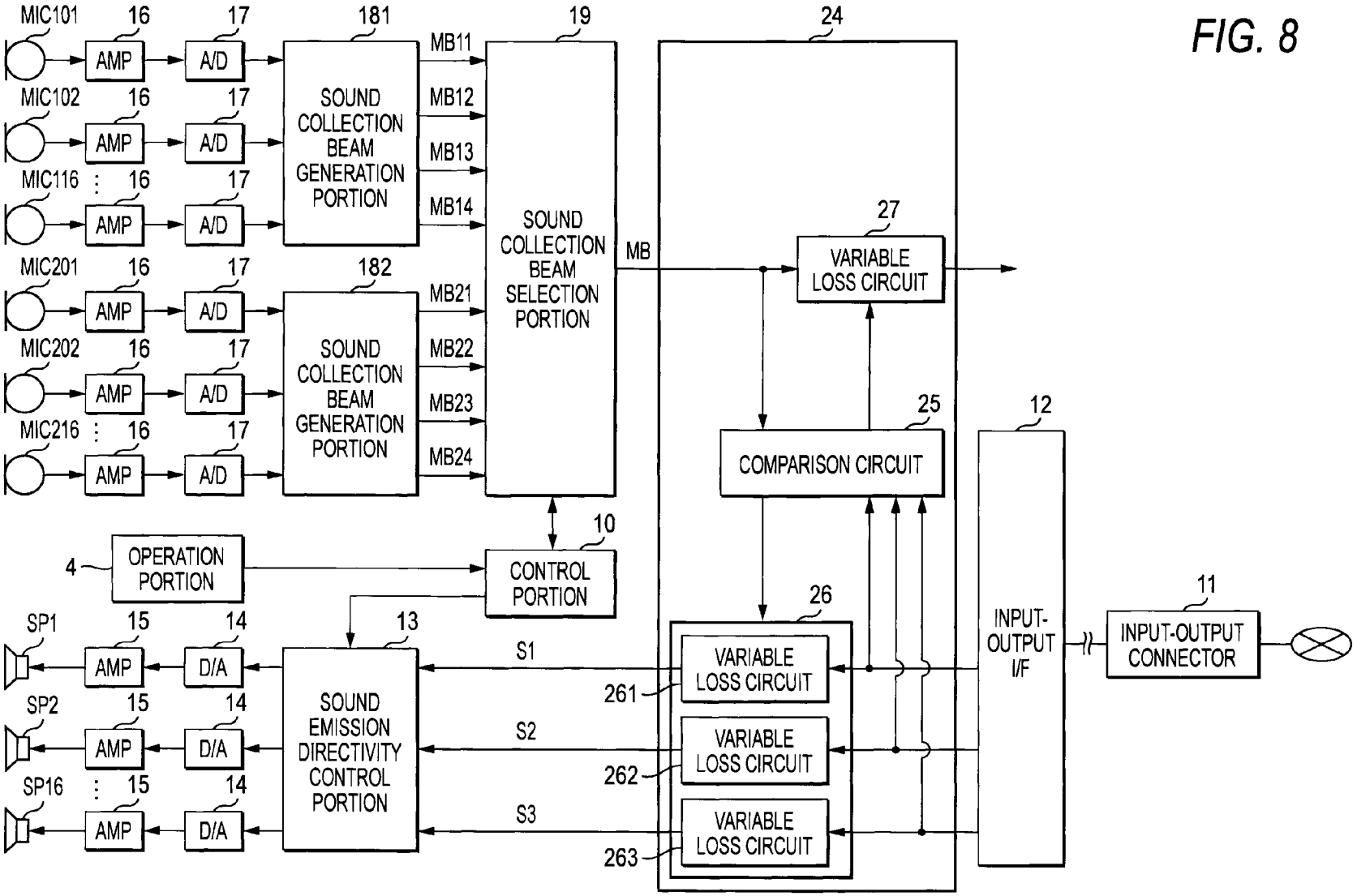
FIG. 8 is a functional block diagram of an audio conferencing apparatus using a voice switch 24.

In the embodiment described above, the example of using the echo canceller (echo cancellation portion 20) as regression sound elimination means is shown, but a voice switch 24 may be used as shown in FIG. 8.

FIG. 8 is a functional block diagram of an audio conferencing apparatus using the voice switch 24.

The audio conferencing apparatus 1 shown in FIG. 8 is an apparatus in which the echo cancellation portion 20 of the audio conferencing apparatus 1 shown in FIG. 3 is replaced with the voice switch 24, and the other configurations are the same.

The voice switch 24 comprises a comparison circuit 25, an input side variable loss circuit 26 and an output side variable loss circuit 27. The comparison circuit 25 inputs input sound signals S1 to S3 and a particular sound collection beam signal MB, and compares signal levels (amplitude intensities) of the input sound signals S1 to S3 with a signal level of the particular sound collection beam signal MB.

Then, when the comparison circuit 25 detects that the signal levels of the input sound signals S1 to S3 are higher than the signal level of the particular sound collection beam signal MB, it decides that a conference person of the audio conferencing apparatus 1 is mainly receiving speech, and reduction control is performed to the output side variable loss circuit 27. The output side variable loss circuit 27 reduces the signal level of the particular sound collection beam signal MB according to this reduction control, and outputs it to an input-output I/F 12 as an output sound signal.

On the other hand, when the comparison circuit 25 detects that the signal level of the particular sound collection beam signal MB is higher than the signal levels of the input sound signals S1 to S3, it decides that the conference person of the audio conferencing apparatus 1 is mainly sending speech, and reduction control is performed to the input side variable loss circuit 26. The input side variable loss circuit 26 comprises individual variable loss circuits 261 to 263 for respectively performing variable loss processing with respect to the input sound signals S1 to S3, and by these individual variable loss circuits 261 to 263, the signal levels of the input sound signals S1 to S3 are reduced and are given to a sound emission directivity control portion 13.

By performing such processing, an output sound level is suppressed even when echo occurs from a speaker array to a microphone array at the time of receiving speech mainly, so that a receiving speech sound (input sound signal) can be prevented from being sent to an opponent audio conferencing apparatus. On the other hand, a sound emitted from the speaker array is suppressed at the time of sending speech, so that a sound diffracted to the microphone array is reduced and the receiving speech sound (input sound signal) can be prevented from being sent to the opponent audio conferencing apparatus.

By comprising the mechanistic configuration and the functional configuration of the embodiment as described above, it can cope with various conference environments as described above by only one audio conferencing apparatus and further, optimum sound emission and collection environments can be provided for a conference person in any conference environments.

The invention claimed is:

1. An audio conferencing apparatus comprising:

a housing having a lower surface, a side surface and a leg portion for separating the lower surface from an installation surface at a predetermined distance;

a speaker array including plural speakers arranged in the lower surface, in which a sound emission direction thereof is an outward direction from the lower surface;

a sound emission controller for performing signal processing for sound emission on an input sound signal to control sound emission directivity of the speaker array;

a microphone array including plural microphones arranged in the side surface, in which a sound collection direction there of is the outward direction from the side surface;

a sound collection controller for performing signal processing for sound collection on a sound collection sound signal collected by the microphone array to generate plural sound collection beam signals having sound collection directivities different from one another, detecting a sound collection environment by comparing the plural sound collection beam signals and selecting and outputting a particular sound collection beam signal; and a regression sound elimination unit for performing control so that the sound emitted from the speaker array is not included in an output sound signal based on the input sound signal and the particular sound collection beam signal.

2. The audio conferencing apparatus according to claim 1, wherein the regression sound elimination unit generates a pseudo regression sound signal based on the input sound signal and subtracts the pseudo regression sound signal from the particular sound collection beam signal.

3. The audio conferencing apparatus according to claim 1, wherein the regression sound elimination unit includes:

a comparator for comparing a level of the input sound signal with a level of the particular sound collection beam signal; and a level reduction unit for reducing a level of the signal which is decided by the comparator to be lower in the level between the input sound signal and the particular sound collection beam signal is lower.

4. The audio conferencing apparatus according to claim 1, wherein the housing has substantially a rectangular parallelepiped shape elongated in one direction, and the plural speakers and the plural microphones are arranged along the elongated direction.

5. The audio conferencing apparatus according to claim 1, further comprising a controller for setting the sound emission directivity based on the sound collection environment from the sound collection controller and giving the sound emission directivity to the sound emission controller.

6. The audio conferencing apparatus according to claim 5, wherein the controller stores a history of the sound collection environment and estimates the sound collection environment and sound emission directivity based on the history and gives the estimated sound emission directivity to the sound emission controller and gives selection control of a sound collection beam signal according to the estimated sound collection environment to the sound collection controller.

7. The audio conferencing apparatus according to claim 5, wherein the controller detects the number of input sound signals and sets the sound emission directivity based on the sound collection environment and the number of input sound signals.

8. The audio conferencing apparatus according to claim 7, wherein the controller stores a history of the sound collection environment and a history of the input sound signal and detects association between a change in the sound collection environment and the input sound signal based on both the histories and gives sound emission directivity estimated based on the association to the sound emission controller and gives selection control of the sound collection beam signal according to the estimated sound collection environment to the sound collection controller.

* * * * *